US011562693B2

(12) United States Patent
Cong et al.

(10) Patent No.: US 11,562,693 B2
(45) Date of Patent: Jan. 24, 2023

(54) DISPLAY DEVICES, PIXEL DRIVING CIRCUITS AND METHODS OF DRIVING THE SAME

(71) Applicants: Beijing BOE Display Technology Co., Ltd., Beijing (CN); BOE Technology Group Co., Ltd., Beijing (CN)

(72) Inventors: Ning Cong, Beijing (CN); Minghua Xuan, Beijing (CN); Can Zhang, Beijing (CN); Xiaochuan Chen, Beijing (CN); Lijun Yuan, Beijing (CN); Qi Qi, Beijing (CN)

(73) Assignees: Beijing BOE Display Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/203,241

(22) Filed: Mar. 16, 2021

(65) Prior Publication Data

US 2022/0036821 A1 Feb. 3, 2022

(30) Foreign Application Priority Data

Jul. 31, 2020 (CN) ..... 202010758941.7

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01);
(Continued)

(58) Field of Classification Search
CPC ..... G09G 3/3233; G09G 2300/0819; G09G 2300/0842; G09G 2310/08; G09G 2320/0233; G09G 2330/02
See application file for complete search history.

(56) References Cited

U.S. PATENT DOCUMENTS 10,187,048 B2 * 1/2019 Sugiyama ..... H03K 5/08
10,636,357 B1 * 4/2020 Brownlow ..... G09G 3/32
(Continued)

FOREIGN PATENT DOCUMENTS

CN 108648678 A 10/2018
CN 109272940 A 1/2019
(Continued)

OTHER PUBLICATIONS

CN2020107589417 first office action.
(Continued)

*Primary Examiner* — Jeff Piziali
(74) *Attorney, Agent, or Firm* — IPro, PLLC

(57) ABSTRACT

A pixel driving circuit includes a current controlling module, an outputting module and a time length controlling module including a comparator, a first energy storage element, an offset voltage writing sub-circuit, and first and second output sub-circuits. First terminal of first energy storage element is connected with first input terminal of comparator and second terminal with the first output sub-circuit. The second output sub-circuit is connected with second input terminal of comparator. The offset voltage writing sub-circuit writes an offset voltage of comparator to the first energy storage element. One of the first and second output sub-circuits outputs time signal and the other outputs reference voltage signal. The comparator outputs comparison signal according to the time signal and the reference voltage signal. The current controlling module outputs current signal. The outputting module turns on responsive to the comparison signal and controls current of light-emitting unit according to the current signal.

20 Claims, 7 Drawing Sheets

(52) U.S. Cl.
CPC . *G09G 2310/08* (2013.01); *G09G 2320/0233* (2013.01); *G09G 2330/02* (2013.01)

(56) References Cited

U.S. PATENT DOCUMENTS

2003/0142048 A1* 7/2003 Nishitani ..... G09G 3/3258 345/82
2006/0007248 A1* 1/2006 Reddy ..... H01L 27/1446 345/690
2009/0027312 A1* 1/2009 Han ..... G09G 3/3233 345/76
2015/0035813 A1 2/2015 Lei
2016/0118971 A1* 4/2016 Sugiyama ..... H03M 1/34 341/158
2017/0188427 A1* 6/2017 Cok ..... G09G 3/2003
2020/0274347 A1 8/2020 Cao et al.
2020/0380910 A1 12/2020 He

FOREIGN PATENT DOCUMENTS

CN 110136642 A 8/2019
CN 111243499 A 6/2020
KR 20050097039 A 10/2005

OTHER PUBLICATIONS

Xu Weijia et al., Designing a high precision comparator for 14-bit pipelined ADC, Hardware and Architecture, Microcomputer and Its Applications, 2017,36(6)133-36, TN432, A, DOI: 10. 19358/j. issn. 1674-7720. 2017. 06. 011.

* cited by examiner

DISPLAY DEVICES, PIXEL DRIVING CIRCUITS AND METHODS OF DRIVING THE SAME

CROSS REFERENCE TO RELATED APPLICATIONS

This application claims priority to Chinese Patent Application No. 2020107589417 entitled "DISPLAY DEVICES, PIXEL DRIVING CIRCUITS AND METHODS OF DRIVING THE SAME" filed on Jul. 31, 2020, the entire content of which is incorporated herein by reference.

TECHNICAL FIELD

The present disclosure relates to the field of display technology, and in particular to a display device, a pixel driving circuit, and a method of driving the pixel driving circuit.

BACKGROUND

Along with development of economy, display devices are applied more and more widely in the lives of people.

A display device includes a plurality of light-emitting units and pixel driving circuits connected with the plurality of light-emitting units one to one. The pixel driving circuit includes a switching transistor and a comparator. The switching transistor is capable of transmitting a current signal to a light-emitting unit upon turning on so as to drive the light-emitting unit to emit light. The comparator is configured to control the switching transistor to turn on and off. However, the light-emitting units in the display device have display brightness with poor uniformity.

SUMMARY

The object of the present disclosure is to provide a display device, a pixel driving circuit and a method of driving the pixel driving circuit so as to improve the uniformity of the display brightness of each light-emitting unit.

According to one aspect of the present disclosure, there is provided a pixel driving circuit, including:

a time length controlling module, including a first output sub-circuit, a second output sub-circuit, a comparator, a first energy storage element, and an offset voltage writing sub-circuit, where a first terminal of the first energy storage element is connected with a first input terminal of the comparator, the first output sub-circuit is connected with a second terminal of the first energy storage element, the second output sub-circuit is connected with a second input terminal of the comparator;

the offset voltage writing sub-circuit is configured to write an offset voltage of the comparator into the first energy storage element;

one of the first output sub-circuit and the second output sub-circuit is configured to output a time signal and the other of the first output sub-circuit and the second output sub-circuit is configured to output a reference voltage signal; and the comparator is configured to output a comparison signal according to the time signal and the reference voltage signal;

a current controlling module, configured to output a current signal; and an outputting module, configured to turn on in response to the comparison signal and control a current of a light-emitting unit according to the current signal Further, one of the first input terminal and the second input terminal of the comparator is an inverting input terminal, the other is a non-inverting input terminal, and the offset voltage writing sub-circuit includes:

a first switching element configured to turn on in response to an energy storage signal so as to communicate an output terminal of the comparator with the inverting input terminal of the comparator; and a switching unit configured to turn on in response to the energy storage signal so as to communicate the second terminal of the first energy storage element with the non-inverting input terminal of the comparator.

Further, the pixel driving circuit further includes a resetting module configured to turn on in response to a reset signal so as to reset the current controlling module, where the energy storage signal and the reset signal are shared.

Further, the switching unit includes:

a second switching element configured to turn on in response to the energy storage signal so as to write a preset signal into the second terminal of the first energy storage element; and a third switching element configured to turn on in response to the energy storage signal so as to write the preset signal into the non-inverting input terminal of the comparator.

Further, the one of the first output sub-circuit and the second output sub-circuit that is configured to output the time signal is a time signal writing sub-circuit, and the time signal writing sub-circuit includes:

a second energy storage element, wherein a first terminal of the second energy storage element is grounded and a second terminal of the second energy storage element is an output terminal of the time signal writing sub-circuit; and a fourth switching element, configured to turn on in response to a data writing control signal so as to write the time signal into the second terminal of the second energy storage element.

Further, the preset signal and the time signal are shared.

Further, the first switching element, the second switching element and the third switching element correspond to a first transistor, a second transistor and a third transistor, respectively;

a control terminal of the first transistor receives the energy storage signal, a first terminal of the first transistor is connected with the output terminal of the comparator and a second terminal of the first transistor is connected with the inverting input terminal of the comparator;

a control terminal of the second transistor receives the energy storage signal, a first terminal of the second transistor receives the preset signal, and a second terminal of the second transistor is connected with the second terminal of the first energy storage element;

a control terminal of the third transistor receives the energy storage signal, a first terminal of the third transistor receives the preset signal, and a second terminal of the third transistor is connected with the non-inverting input terminal of the comparator.

Further, the current controlling module includes a current writing sub-circuit and a compensation sub-circuit, the compensation sub-circuit is connected with the current writing sub-circuit and the outputting module, and the compensation sub-circuit includes a compensation transistor, a current storage capacitor and a drive transistor;

a first terminal of the drive transistor is connected with the current writing sub-circuit, a second terminal of the drive transistor is connected with a first terminal of the compensation transistor, a control terminal of the drive transistor and a second terminal of the compensation transistor are both connected to a first terminal of the current storage capacitor, a control terminal of the compensation transistor is configured to receive the data writing control signal, and a second terminal of the current storage capacitor receives a first power signal.

Further, a width-to-length ratio of a channel region of the drive transistor is greater than 3.

Further, the pixel driving circuit further includes an operation controlling module configured to turn on in response to an operation control signal so as to transmit the current signal to the outputting module.

Further, the reference voltage signal is a ramp signal, a triangular wave signal, a sawtooth wave signal, a sine wave signal or a cosine wave signal.

Further, the pixel driving circuit further includes:

a resetting module, configured to turn on in response to a reset signal so as to reset the current controlling module; and an operation controlling module, configured to turn on in response to an operation control signal so as to transmit the current signal to the outputting module.

According to another aspect of the present disclosure, there is provided a method of driving a pixel driving circuit, applied to any of the above pixel driving circuits, the method of driving the pixel driving circuit including:

writing the offset voltage of the comparator into the first energy storage element by using the offset voltage writing sub-circuit;

enabling the current controlling module to output a current signal, and enabling one of the first output sub-circuit and the second output sub-circuit to output a time signal, and the other to output a reference voltage signal so that the comparator outputs a comparison signal according to the time signal and the reference voltage signal;

causing the outputting module to turn on in response to the comparison signal, and controlling a current of a light-emitting unit according to the current signal by the outputting module.

According to another aspect of the present disclosure, there is provided a display device, including a plurality of pixel driving circuits, and a plurality of light-emitting units connected with the plurality of pixel driving circuits one to one, where each of the pixel driving circuits includes:

a time length controlling module, including a first output sub-circuit, a second output sub-circuit, a comparator, a first energy storage element, and an offset voltage writing sub-circuit, where a first terminal of the first energy storage element is connected with a first input terminal of the comparator, the first output sub-circuit is connected with a second terminal of the first energy storage element, the second output sub-circuit is connected with a second input terminal of the comparator;

the offset voltage writing sub-circuit is configured to write an offset voltage of the comparator into the first energy storage element;

one of the first output sub-circuit and the second output sub-circuit is configured to output a time signal and the other is configured to output a reference voltage signal; and the comparator is configured to output a comparison signal according to the time signal and the reference voltage signal;

a current controlling module configured to output a current signal; and an outputting module configured to turn on in response to the comparison signal and control a current of a corresponding light-emitting unit according to the current signal.

Further, one of the first input terminal and the second input terminal of the comparator is an inverting input terminal, the other is a non-inverting input terminal, and the offset voltage writing sub-circuit includes:

a first switching element configured to turn on in response to an energy storage signal so as to communicate an output terminal of the comparator with the inverting input terminal of the comparator; and a switching unit configured to turn on in response to the energy storage signal so as to communicate the second terminal of the first energy storage element with the non-inverting input terminal of the comparator.

Further, the switching unit includes:

a second switching element configured to turn on in response to the energy storage signal so as to write a preset signal into the second terminal of the first energy storage element; and a third switching element configured to turn on in response to the energy storage signal so as to write the preset signal into the non-inverting input terminal of the comparator.

Further, the one of the first output sub-circuit and the second output sub-circuit that is configured to output the time signal is a time signal writing sub-circuit, and the time signal writing sub-circuit includes:

a second energy storage element, wherein a first terminal of the second energy storage element is grounded and a second terminal of the second energy storage element is an output terminal of the time signal writing sub-circuit; and a fourth switching element, configured to turn on in response to a data writing control signal so as to write the time signal into the second terminal of the second energy storage element.

Further, the preset signal and the time signal are shared.

Further, the first switching element, the second switching element and the third switching element correspond to a first transistor, a second transistor and a third transistor, respectively;

a control terminal of the first transistor receives the energy storage signal, a first terminal of the first transistor is connected with the output terminal of the comparator and a second terminal of the first transistor is connected with the inverting input terminal of the comparator;

a control terminal of the second transistor receives the energy storage signal, a first terminal of the second transistor receives the preset signal, and a second terminal of the second transistor is connected with the second terminal of the first energy storage element;

a control terminal of the third transistor receives the energy storage signal, a first terminal of the third transistor receives the preset signal, and a second terminal of the third transistor is connected with the non-inverting input terminal of the comparator.

Further, the current controlling module includes a current writing sub-circuit and a compensation sub-circuit, the compensation sub-circuit is connected with the current writing sub-circuit and the outputting module, and the compensation sub-circuit includes a compensation transistor, a current storage capacitor and a drive transistor;

a first terminal of the drive transistor is connected with the current writing sub-circuit, a second terminal of the drive transistor is connected with a first terminal of the compensation transistor, a control terminal of the drive transistor and a second terminal of the compensation transistor are both connected with a first terminal of the current storage capacitor, a control terminal of the compensation transistor is configured to receive the data writing control signal, and a second terminal of the current storage capacitor receives a first power signal.

DETAILED DESCRIPTION

Figure 1:
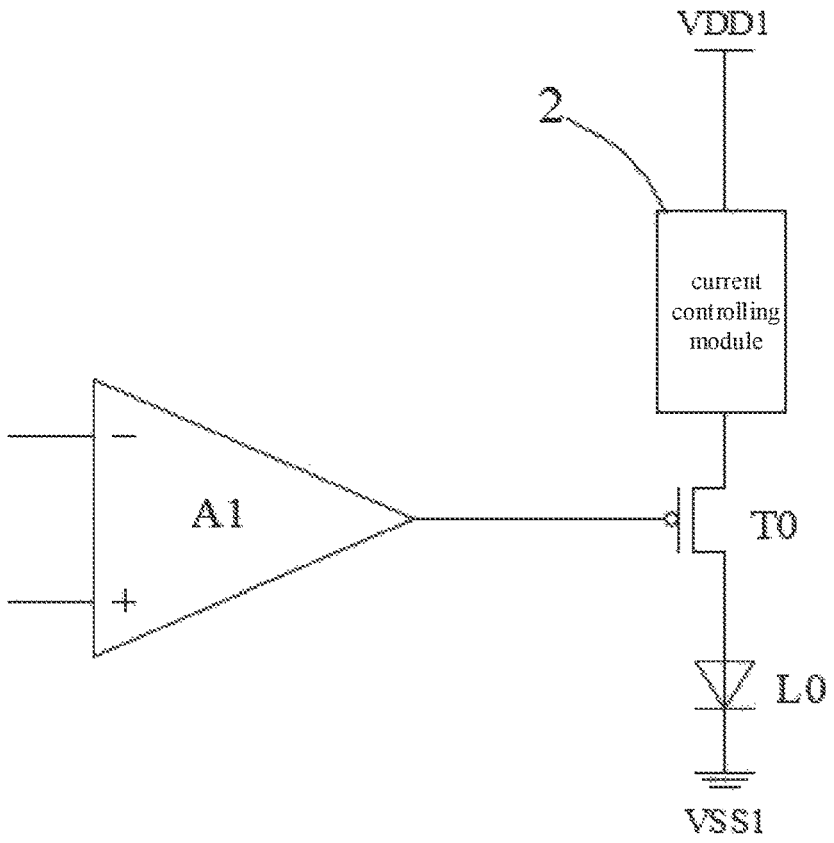
FIG. 1 is a schematic diagram of a pixel driving circuit in the related art.

Examples will be described in detail herein, with the illustrations thereof represented in the drawings. When the following descriptions involve the drawings, like numerals in different drawings refer to like or similar elements unless otherwise indicated. The examples described in the following examples do not represent all examples consistent with the present disclosure. Rather, they are merely examples of apparatuses consistent with some aspects of the present disclosure as detailed in the appended claims.

The terms used in the present disclosure are for the purpose of describing particular examples only, and are not intended to limit the present disclosure. Unless otherwise defined, the technical terms or scientific terms used in the present disclosure shall have general meanings that can be understood by persons of ordinary skill in the art. "First" "second" and the like used in the specification and claims do not represent any sequence, quantity or importance, but distinguish different components. Similarly, "one" or "a" and the like do not represent quantity limitation but represent at least one. "A plurality" or "several" represents two or more. "Include" or "contain" or the like is intended to refer to that an element or object appearing before "include" or "contain" covers an element or object or its equivalents listed after "include" or "contain" and does not preclude other elements or objects. "Connect" or "connect with" or the like is not limited to physical or mechanical connection but includes electrical connection, directly or indirectly. The singular forms such as "a", 'said", and "the" used in the present disclosure and the appended claims are also intended to include multiple, unless the context clearly indicates otherwise. It is also to be understood that the term "and/or" as used herein refers to any or all possible combinations that include one or more associated listed items.

In the related art, a pixel driving circuit includes a comparator A1, a current controlling module 2, a switching transistor T0, and a light-emitting unit L0 as shown in FIG. 1. A first terminal of the switching transistor T0 is connected with the current controlling module 2, a second terminal of the switching transistor T0 is connected with the light-emitting unit L0, and a control terminal of the switching transistor T0 is connected with an output terminal of the comparator A1. When the switching transistor T0 turns on, the current controlling module 2 outputs a current to the light-emitting unit L0 to enable the light-emitting unit L0 to emit light; when the switching transistor T0 turns off, the light-emitting unit L0 goes off. The output terminal of the comparator A1 is capable of generating a square wave signal to control the switching transistor T0 to turn on and off, thereby further controlling a light-emitting time length of the light-emitting unit L0.

Figure 2:
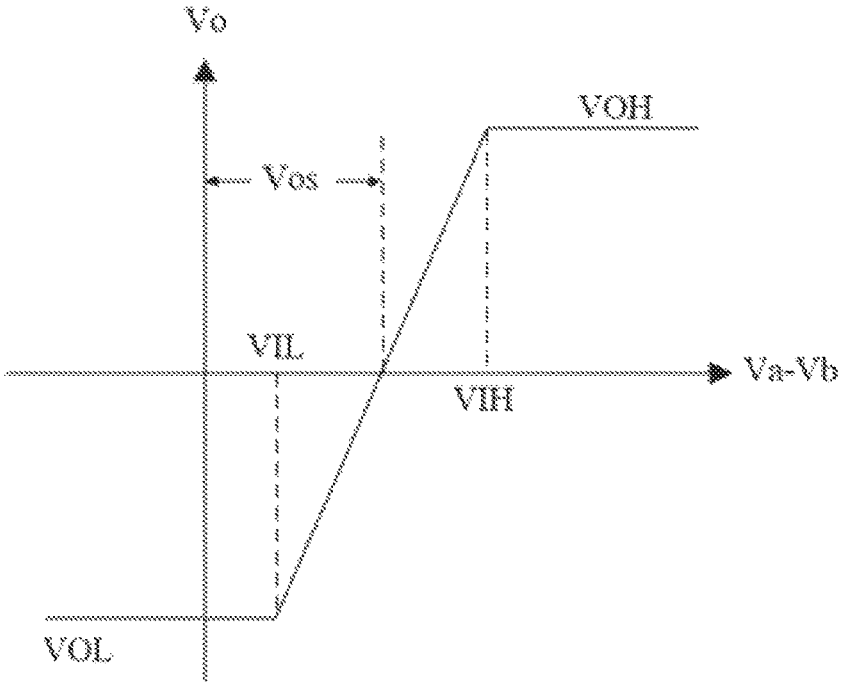
FIG. 2 is a schematic diagram of a transmission curve of a comparator having an offset voltage.
Figure 3:
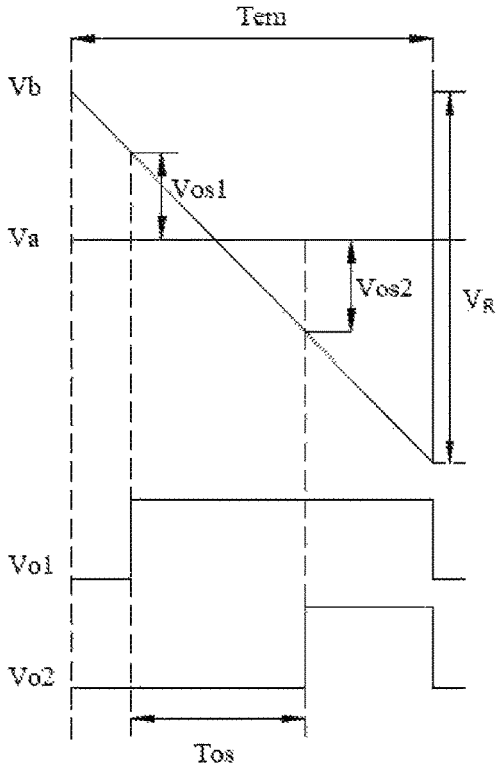
FIG. 3 is a schematic diagram of a square wave signal output by a comparator subjected to impact of an offset voltage.

Due to limitation of a device manufacturing process, the comparator A1 has an offset voltage. The offset voltage is an input offset voltage of the comparator A1. In an ideal state, when voltages at two input terminals of the comparator A1 are same, a voltage at the output terminal of the comparator A1 is 0V. However, when voltages at the two input terminals are the same, the comparator A1 in an actual state has an offset voltage, and therefore the voltage at the output terminal of the comparator A1 is not 0V. In order to enable the voltage at the output terminal of the comparator A1 in an actual state to be 0V, a direct current voltage difference is to be applied between the two input terminals, and the direct current voltage difference is the offset voltage of the comparator A1. FIG. 2 shows a transmission curve of the comparator A1 having an offset voltage, where Vos represents an offset voltage, Va and Vb represent signals of the input terminals of the comparator A1 respectively, VIH represents an input voltage required to enable the output to reach an upper limit, VIL represents an input voltage required to enable the output to reach a lower limit, VOH represents a maximum output value, VOL represents a minimum output value, abscissa (Va−Vb) represents a difference between the input terminal signal Va of the comparator A1 and the input terminal signal Vb of the comparator A1, ordinate Vo represents a potential of the output terminal. It can be seen that the output changes when a difference of signals of the two input terminals is equal to the offset voltage Vos. It is known that the offset voltage of the comparator A1 will affect a square wave signal output by the comparator A1. As shown in FIG. 3, Va and Vb represent signals of the input terminals of the comparator A1 respectively, Vb is a ramp signal, $V_R$ is a voltage amplitude of a ramp signal, which corresponds to a time Tem, Vo1 and Vo2 correspond to the output signals when the offset voltage is Vos1 and Vos2, respectively. It can be known that although the input voltages of the comparator A1 are same, a difference in low level time lengths and a difference in high level time lengths of square wave signals output when the offset voltage is Vos1 and Vos2 respectively are both Tos. At the same time, as shown in FIG. 3, the relationship between the difference of the offset voltages and the difference of the time lengths is as follows:

$$Tos=(Vos2-Vos1)Tem/V_R$$

where Vos1 is smaller than zero. It is known that the difference of the offset voltages is directly proportional to the difference of the time lengths.

The formula of the brightness uniformity of the light-emitting unit L0 is as follows:

$$Unif. = \frac{L_{min}}{L_{max}} \times 100\%;$$

where Unif. represents the brightness uniformity, Lmin represents lowest brightness of a display device when displaying a white picture, Lmax represents highest brightness. For a current-driven light-emitting unit L0, when the current is constant, brightness is directly proportional to light emitting time. Therefore, the above brightness uniformity formula may be converted as follows:

$$Unif. = \frac{L_{min}}{L_{max}} \times 100\% = \frac{T_{min}}{T_{max}} \times 100\%;$$

where Tmin is a shortest light emitting time of a display device when displaying a white picture, and Tmax is a longest light emitting time.

Figure 4:
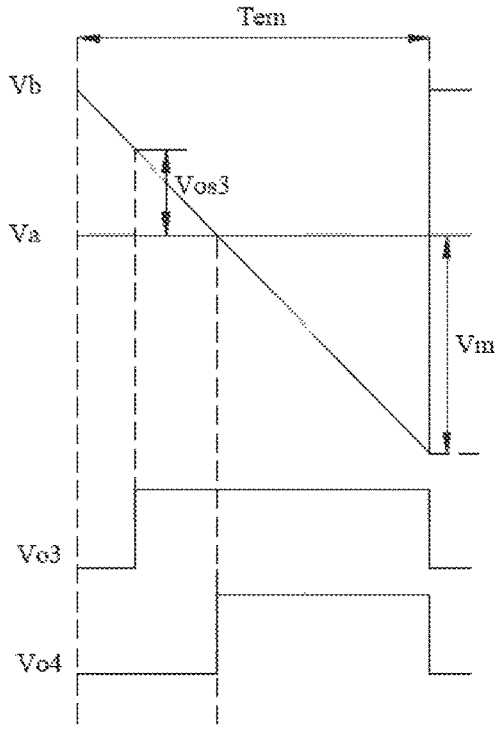
FIG. 4 is another schematic diagram of a square wave signal output by a comparator subjected to impact of an offset voltage.

As shown in FIG. 4, Vo3 corresponds to an output signal when the offset voltage is Vos3, Vo4 corresponds to an output signal when the offset voltage is 0, and Vm is equal to a maximum value of Va-Vb. With the switching transistor T0 being an N-type transistor an example, the switching transistor T0 turns on when the control terminal of the switching transistor T0 receives signals at a high level. If duration of the high level time length in the square wave signal output by the comparator A1 is maximum when the offset voltage of the comparator A1 is Vo3, and is minimum when the offset voltage of the comparator A1 is 0, the above brightness uniformity formula can be converted to:

$$\text{Unif.}=Vm/(Vm-Vos3)$$

where Vos3 is a negative number. It can be known that the offset voltage may affect the brightness uniformity of the display device.

Figure 5:
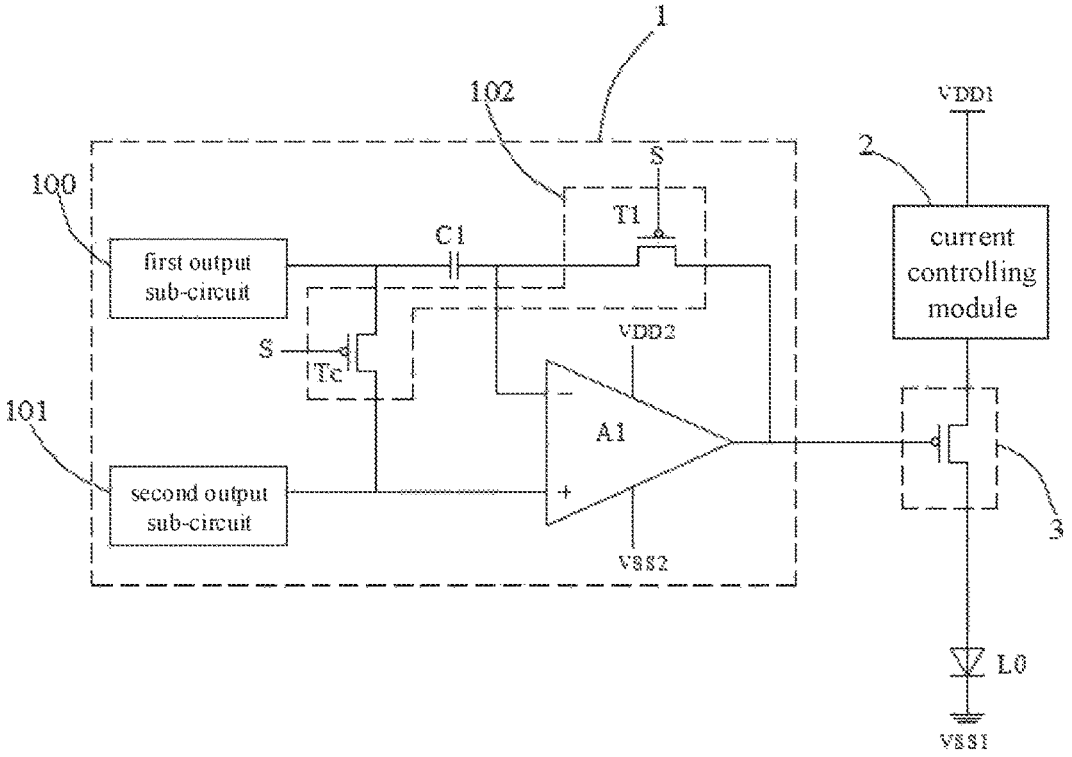
FIG. 5 is a schematic diagram of a pixel driving circuit according to an example of the present disclosure.
Figure 6:
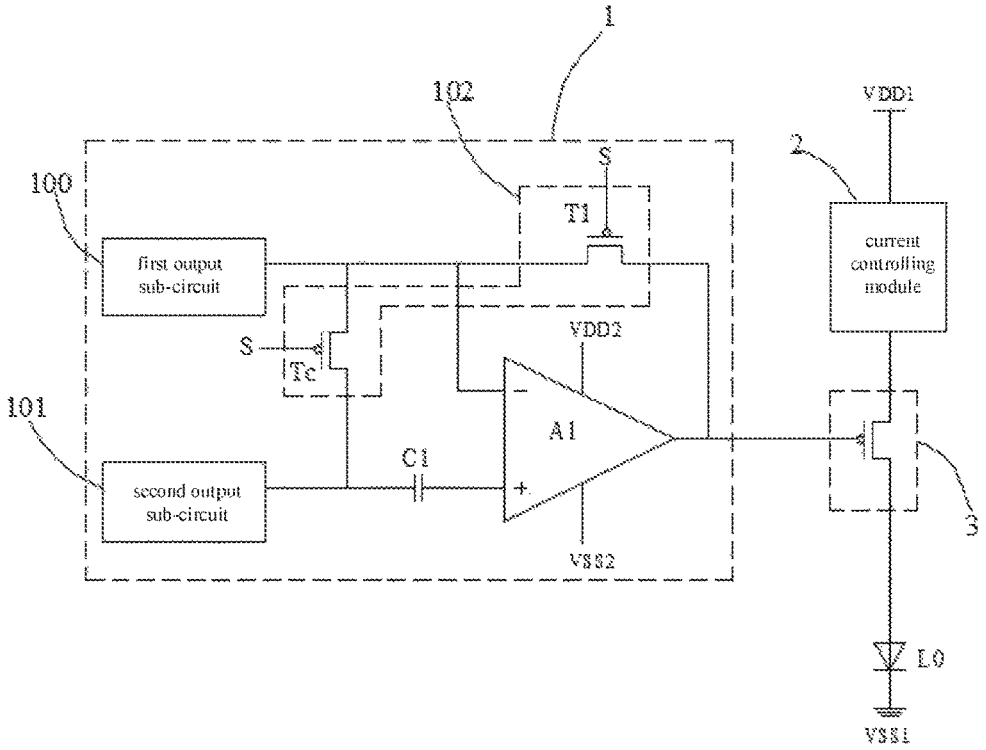
FIG. 6 is a schematic diagram of a pixel driving circuit according to another example of the present disclosure.

In order to solve the above problem, an example of the present disclosure provides a pixel driving circuit configured to drive a display device to emit light. As shown in FIGS. 5 and 6, the pixel driving circuit may include a time length controlling module 1, a current controlling module 2 and an outputting module 3.

The time length controlling module 1 includes a comparator A1, a first energy storage element C1, an offset voltage writing sub-circuit 102, a first output sub-circuit 100, and a second output sub-circuit 101. A first terminal of the first energy storage element C1 is connected with a first input terminal of the comparator A1. The first output sub-circuit 100 is connected with a second terminal of the first energy storage element C1 and the second output sub-circuit 101 is connected with a second input terminal of the comparator A1. One of the first input terminal and the second input terminal of the comparator A1 is an inverting input terminal and the other of the first input terminal and the second input terminal of the comparator A1 is a non-inverting input terminal. The offset voltage writing sub-circuit 102 is configured to write an offset voltage of the comparator A1 into the first energy storage element C1. One of the first output sub-circuit 100 and the second output sub-circuit 101 outputs a time signal Vdata_T, and the other of the first output sub-circuit 100 and the second output sub-circuit 101 outputs a reference voltage signal Vramp_T. The comparator A1 is configured to output a comparison signal according to the time signal Vdata_T and the reference voltage signal Vramp_T. The current controlling module 2 is configured to output a current signal. The outputting module 3 is configured to turn on in response to the comparison signal and control a current of the light-emitting unit L0 according to the current signal.

In the pixel driving circuit according to the examples of the present disclosure, the offset voltage writing sub-circuit 102 writes the offset voltage of the comparator A1 into the first energy storage element C1. In this way, the influence of the offset voltage can be eliminated when the output terminal of the comparator A1 outputs the comparison signal, thereby ensuring the uniformity of the display brightness of light-emitting units L0.

Different parts of the pixel driving circuit in the examples of the present disclosure will be detailed below.

As shown in FIGS. 5 and 6, the time length controlling module 1 includes comparator A1, first energy storage element C1, offset voltage writing sub-circuit 102, first output sub-circuit 100, and second output sub-circuit 101.

The comparator A1 is configured to output the comparison signal according to a signal received by the non-inverting input terminal and a signal received by the inverting input terminal. When the voltage of the non-inverting input terminal of the comparator A1 is greater than the voltage of the inverting input terminal, the output terminal of the comparator A1 may output a high level; when the voltage of the non-inverting input terminal of the comparator A1 is smaller than the voltage of the inverting input terminal, the output terminal of the comparator A1 may output a low level.

The first terminal of the first energy storage element C1 may be connected with the inverting input terminal of the comparator A1, that is to say, the first input terminal of the comparator A1 is the inverting input terminal of the comparator A1. Of course, in the present disclosure, the first terminal of the first energy storage element C1 may instead be connected with the non-inverting input terminal of the comparator A1, that is to say, the first input terminal of the comparator A1 is the non-inverting input terminal of the comparator A1. The first energy storage element C1 may be an energy storage capacitor.

The offset voltage writing sub-circuit 102 may include a first switching element T1, and a switching unit Tc. The first switching element T1 is configured to turn on in response to an energy storage signal S so as to communicate the output terminal of the comparator A1 with the inverting input terminal of the comparator A1, thus introducing a negative feedback into the comparator A1. The switching unit Tc is configured to turn on in response to the energy storage signal S so as to communicate the non-inverting input terminal of the comparator A1 with the second terminal of the first energy storage element C1. The energy storage signal S may be provided by an energy storage signal line.

Figure 14:
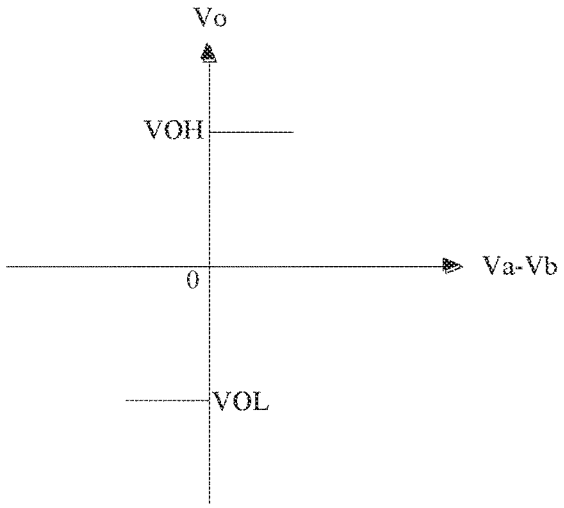
FIG. 14 is a schematic diagram of a transmission curve of a comparator in a pixel driving circuit according to an example of the present disclosure.

As shown in FIG. 5, with the first terminal of the first energy storage element C1 being connected with the inverting input terminal of the comparator A1 as an example, the second terminal of the first energy storage element C1 is connected with the non-inverting input terminal of the comparator A1 through the switching unit Tc. In this case, when the first switching element T1 and the switching unit Tc both turn on, a potential of the first terminal of the first energy storage element C1 is equal to a potential of the inverting input terminal of the comparator A1, and a potential of the second terminal of the first energy storage element C1 is equal to a potential of the non-inverting input terminal of the comparator A1. Thus, a potential difference between the second terminal and the first terminal of the first energy storage element C1 is the offset voltage of the comparator A1. Further, because the first output sub-circuit 100 is connected with the second terminal of the first energy storage element C1 and the second output sub-circuit 101 is connected with the non-inverting input terminal of the comparator A1, the influence of the offset voltage can be eliminated. The corresponding transmission curve is shown in FIG. 14.

As shown in FIG. 6, with the first terminal of the first energy storage element C1 being connected with the non-inverting input terminal of the comparator A1 as an example, the second terminal of the first energy storage element C1 is connected with the inverting input terminal of the comparator A1 through the switching unit Tc. In this case, when the first switching element T1 and the switching unit Tc both turn on, a potential of the first terminal of the first energy storage element C1 is equal to a potential of the non-inverting input terminal of the comparator A1, and a potential of the second terminal of the first energy storage element C1 is equal to a potential of the inverting input terminal of the comparator A1. Thus, a potential difference between the first terminal and the second terminal of the first energy storage element C1 is the offset voltage of the comparator A1. Further, because the first output sub-circuit 100 is connected with the inverting input terminal of the comparator, and the second output sub-circuit 101 is connected with the second terminal of the first energy storage element C1, the influence of the offset voltage can be eliminated.

Figure 7:
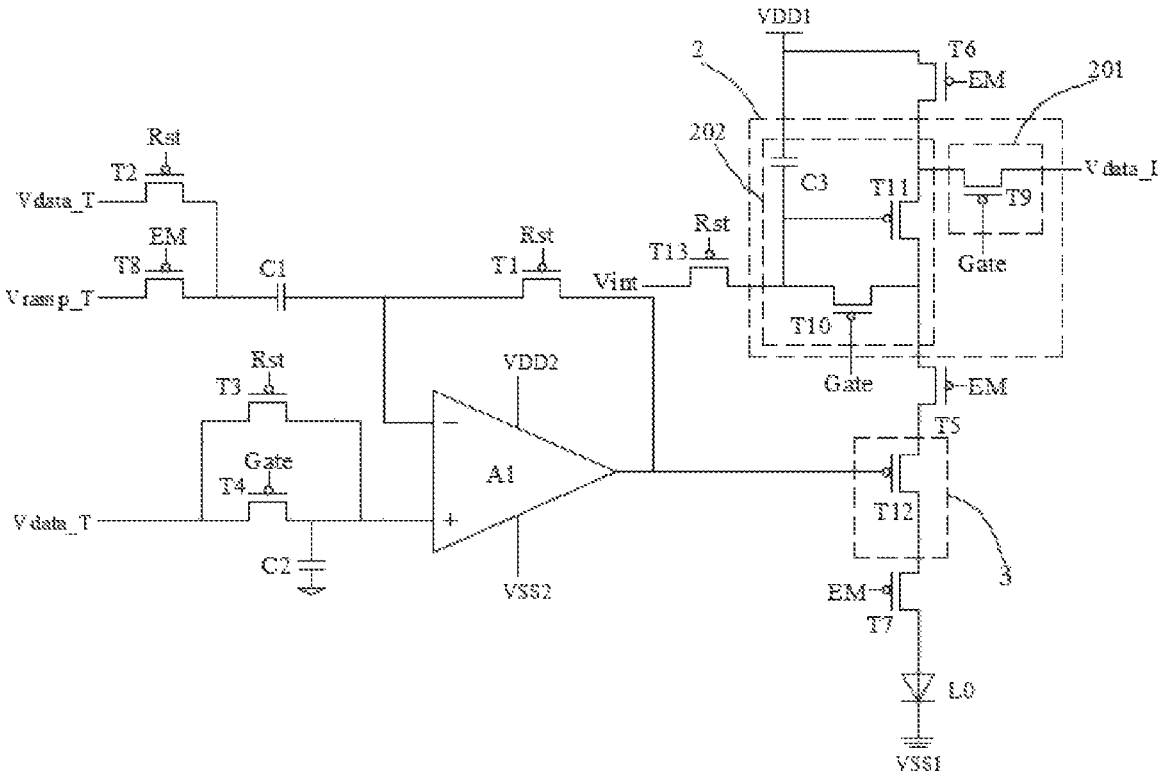
FIG. 7 is a schematic diagram of a pixel driving circuit according to still another example of the present disclosure.
Figure 13:
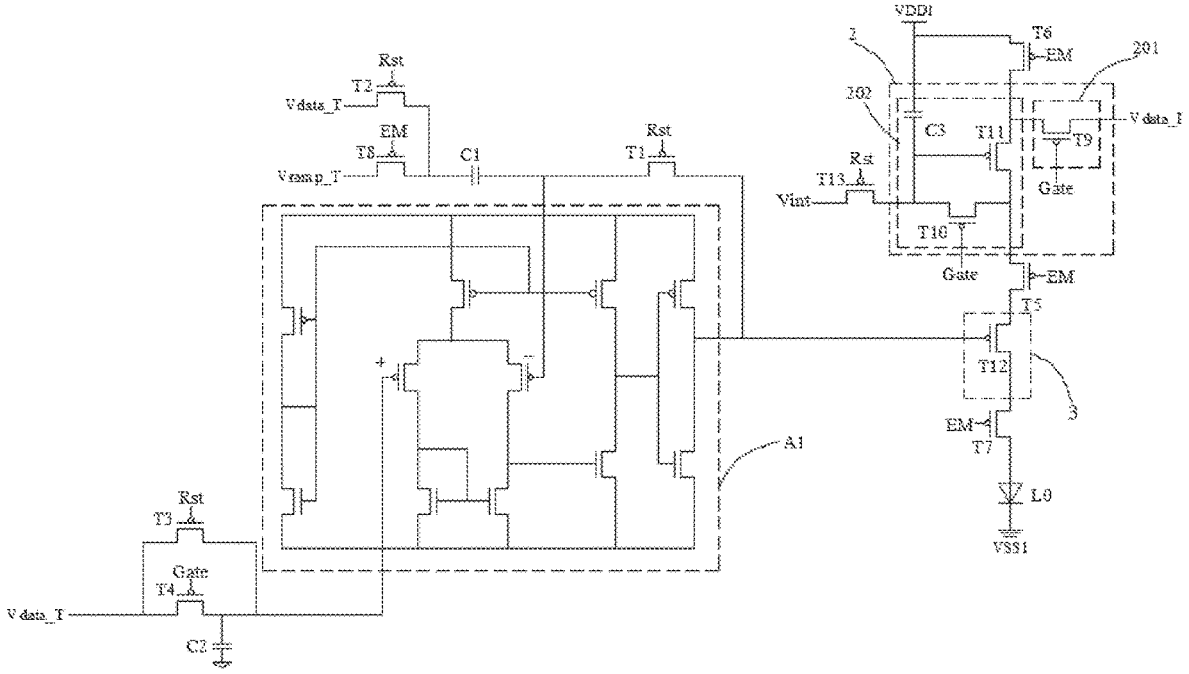
FIG. 13 is a specific structural diagram of a circuit structure shown in FIG. 7.

As shown in FIG. 7, the above first switching element T1 may be a first transistor. A first terminal of the first transistor is connected with the output terminal of the comparator A1, a control terminal of the first transistor receives an energy storage signal S, and a second terminal of the first transistor is connected with the inverting input terminal of the comparator A1. The above switching unit Tc may include a second switching element T2 and a third switching element T3. The second switching element T2 is configured to turn on in response to the energy storage signal S so as to write a preset signal into the second terminal of the first energy storage element C1, where the preset signal may be provided by a preset signal line. The third switching element T3 is configured to turn on in response to the energy storage signal S so as to write the preset signal into the non-inverting input terminal of the comparator A1. The second switching element T2 may be a second transistor. A control terminal of the second transistor receives the energy storage signal S, a first terminal of the second transistor receives the preset signal, and a second terminal of the second transistor is connected with the second terminal of the first energy storage element C1. The third switching element T3 may be a third transistor. A control terminal of the third transistor receives the energy storage signal S, a first terminal of the third transistor receives the preset signal, and a second terminal of the third transistor is connected with the non-inverting input terminal of the comparator A1. FIG. 13 is another showing of the circuit structure shown in FIG. 7, where the specific structure of the comparator A1 is given.

As shown in FIGS. 5 and 6, one of the first output sub-circuit 100 and the second output sub-circuit 101 is a reference voltage writing sub-circuit and the other is a time signal writing sub-circuit. The reference voltage writing sub-circuit may output a reference voltage signal Vramp_T and the time signal writing sub-circuit may output a time signal Vdata_T. The comparator A1 is configured to output a comparison signal according to the time signal Vdata_T and the reference voltage signal Vramp_T. In an example, the first output sub-circuit 100 is the reference voltage writing sub-circuit and the second output sub-circuit 101 is the time signal writing sub-circuit. In this case, when a voltage of the time signal Vdata_T is greater than a voltage of the reference voltage signal Vramp_T, the comparator A1 outputs a comparison signal of high level. When the voltage of the time signal Vdata_T is smaller than the voltage of the reference voltage signal Vramp_T, the comparator A1 outputs a comparison signal of low level. In another example, the first output sub-circuit 100 is the time signal writing sub-circuit and the second output sub-circuit 101 is the reference voltage writing sub-circuit. In this case, when the voltage of the time signal Vdata_T is greater than the voltage of the reference voltage signal Vramp_T, the comparator A1 outputs a comparison signal of low level. When the voltage of the time signal Vdata_T is smaller than the voltage of the reference voltage signal Vramp_T, the comparator A1 outputs a comparison signal of high level.

As shown in FIG. 7, the reference voltage writing sub-circuit may include a voltage writing transistor T8. A first terminal of the voltage writing transistor T8 receives the reference voltage signal Vramp_T, a second terminal of the voltage writing transistor T8 is an output terminal of the reference voltage writing sub-circuit, and a control terminal of the voltage writing transistor T8 receives an operation control signal EM. The reference voltage signal Vramp_T may be provided by a reference voltage signal line. The reference voltage signal Vramp_T may be ramp signal, or a triangular wave signal. But the reference voltage signal is not limited to the above two signals and may further be a sawtooth wave signal, a sine wave signal, a cosine wave signal and the like. The operation control signal EM may be provided by a operation control signal line.

As shown in FIG. 7, the time signal writing sub-circuit may include a second energy storage element C2 and a fourth switching element T4. A first terminal of the second energy storage element C2 is grounded, and a second terminal of the second energy storage element C2 is an output terminal of the time signal writing sub-circuit. The second energy storage element C2 may be an energy storage capacitor. The fourth switching element T4 is configured to turn on in response to a data writing control signal Gate so as to transmit the time signal Vdata_T to the second terminal of the second energy storage element C2. The data writing control signal Gate may be provided by a data writing control signal Gate line. The time signal Vdata_T may be provided by a time signal line. The above preset signal and the time signal Vdata_T may be shared, that is, the preset signal and the time signal Vdata_T are a same signal, which helps to reduce the number of wires and simplify the circuit structure. The fourth switching element T4 may be a fourth transistor. A first terminal of the fourth transistor receives the time signal Vdata_T, a second terminal of the fourth transistor is connected with the second terminal of the second energy storage element C2, and a control terminal of the fourth transistor receives the data writing control signal Gate.

As shown in FIG. 7, the current controlling module 2 is configured to output a current signal. The current controlling module 2 may include a current writing sub-circuit 201 and a compensation sub-circuit 202.

The current writing sub-circuit may include a current writing transistor T9. A control terminal of the current writing transistor T9 receives the data writing control signal Gate, and a first terminal of the current writing transistor T9 receives a current signal Vdata-I. The current signal may be provided by a current signal line.

The compensation sub-circuit 202 may be connected with the current writing sub-circuit 201. The compensation sub-circuit 202 may include a drive transistor T11, a current storage capacitor C3, and a compensation transistor T10. A first terminal of the drive transistor T11 is connected with the current writing sub-circuit 201 to connect the compensation sub-circuit 202 with the current writing sub-circuit 201. The current writing sub-circuit 201 includes, for example, the current writing transistor T9. In this case, a first terminal of the drive transistor T11 is connected with a second terminal of the current writing transistor T9. A control terminal of the drive transistor T11 is connected with a first terminal of the current storage capacitor C3. A first terminal of the compensation transistor T10 is connected with a second terminal of the drive transistor T11, a second terminal of the compensation transistor T10 is connected with the first terminal of the current storage capacitor C3, and a control terminal of the compensation transistor T10 receives the data writing control signal Gate. A second terminal of the current storage capacitor C3 receives a first power signal VDD1.

As shown in FIG. 7, the outputting module 3 is connected with the time length controlling module 1 and the current controlling module 2. The outputting module 3 is connected with the output terminal of the comparator A1 in the time length controlling module 1 to receive a comparison signal from the comparator A1. The outputting module 3 is connected with the second terminal of the drive transistor T11 in the current controlling module 2 to receive a current signal from the second terminal of the drive transistor T11. The outputting module 3 is configured to turn on in response to the comparison signal and control the current of the light-emitting unit L0 according to the current signal. The outputting module 3 may include an output transistor T12. A first terminal of the output transistor T12 is connected with the second terminal of the drive transistor T11, a second terminal of the output transistor T12 is connected with the light-emitting unit L0, and a control terminal of the output transistor T12 is connected with the output terminal of the comparator A1. The second terminal of the output transistor T12 may be connected with a first pole of the light-emitting unit L0, and a second pole of the light-emitting unit L0 receives a second power signal VSS1. The light-emitting unit L0 is a current-driven light-emitting unit which is controlled to emit light by a current flowing through the drive transistor T11. The light-emitting unit L0 may be for example a micro light-emitting diode (micro LED), a mini LED, or an OLED.

As shown in FIG. 7, the pixel driving circuit according to the examples of the present disclosure may further include a resetting module. The resetting module is configured to turn on in response to a reset signal Rst so as to reset the current controlling module 2. The resetting module may include a reset transistor T13. A first terminal of the reset transistor T13 receives a reference signal Vint, a control terminal of the reset transistor T13 receives the reset signal Rst, and a second terminal of the reset transistor T13 is connected with the current controlling module 2, where the second terminal of the reset transistor T13 is connected with the first terminal of the current storage capacitor C3 in the current controlling module 2. The reference signal Vint may be provided by a reference signal V line, and the reset signal Rst may be provided by a reset signal line. The above energy storage signal S and the reset signal Rst may be shared, that is, the energy storage signal S and the reset signal Rst are a same signal, which helps to reduce the number of wires and simplify the circuit structure.

As shown in FIG. 7, the pixel driving circuit according to the examples of the present disclosure may further include a operation controlling module. The operation controlling module is configured to turn on in response to an operation control signal EM so as to transmit a current signal to the outputting module 3. The operation controlling module may include a fifth transistor T5, a sixth transistor T6 and a seventh transistor T7. Control terminals of the fifth transistor T5, the sixth transistor T6 and the seventh transistor T7 all receive the operation control signal EM.

As shown in FIG. 7, a first terminal of the fifth transistor T5 is connected with the current controlling module 2 and a second terminal of the fifth transistor T5 is connected with the outputting module 3. In an example, the first terminal of the fifth transistor T5 is connected with the second terminal of the drive transistor T11, and the second terminal of the fifth transistor T5 is connected with the first terminal of the output transistor T12. With configuration of the fifth transistor T5, the relative independence of the current controlling module 2 and the outputting module 3 can be guaranteed to avoid mutual influence of both. A first terminal of the sixth transistor T6 receives the first power signal VDD1 and a second terminal of the sixth transistor T6 is connected with the first terminal of the drive transistor T11. With the configuration of the sixth transistor T6, a voltage may be provided to the drive transistor T11. A first terminal of the seventh transistor T7 is connected with the outputting module 3 and a second terminal of the seventh transistor T7 is connected with the first pole of the light-emitting unit L0.

All the above transistors may be an N-type thin-film transistor, which is not limited herein. All the above transistors may instead be a P-type thin-film transistor.

Figure 8:
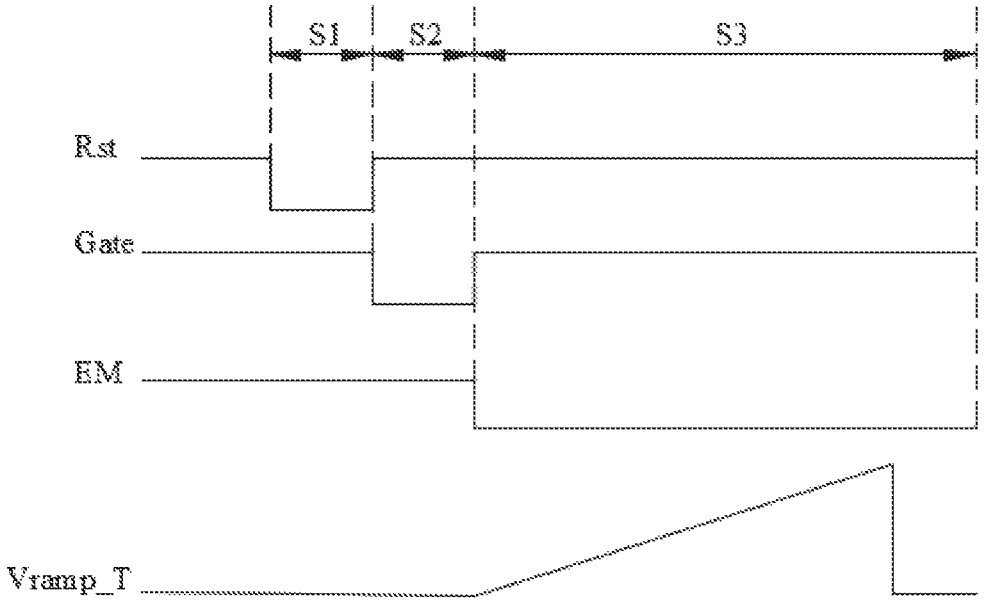
FIG. 8 is a diagram of an operation timing of the pixel driving circuit shown in FIG. 7.
Figure 12:
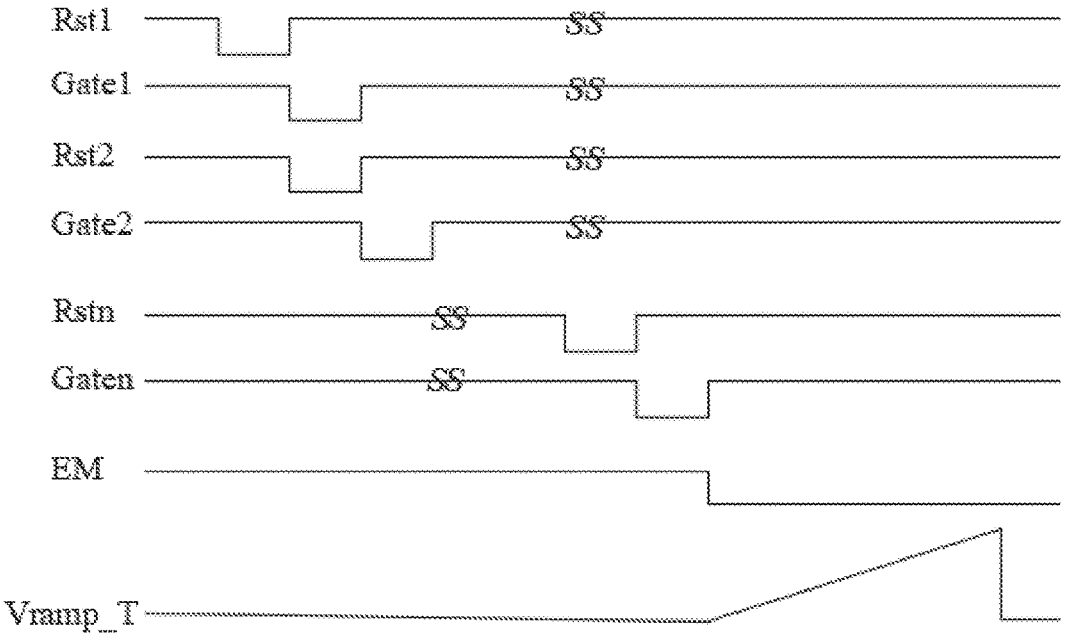
FIG. 12 is a diagram of another operation timing of the pixel driving circuit shown in FIG. 7.

The operation process of the pixel driving circuit shown in FIG. 7 will be detailed below in combination with the operation timing diagram of the pixel driving circuit in FIG. 8. For example, all the above transistors are a P-type thin-film transistor and the turning-on levels of all the transistors are a low level. The first power signal VDD1 is a high level signal and the second power signal VSS1 is a low level signal. The operation timing diagram depicts level states of the reference voltage signal Vramp_T, the reset signal Rst, the data writing control signal Gate and the operation control signal EM at three stages. FIG. 8 is timing diagram of signals for pixel driving circuits of one row of pixels in one frame period, and FIG. 12 is timing diagram of signals for pixel driving circuits of a plurality of rows of pixels in one frame period. It is assumed that the display device of the present disclosure includes n rows of pixels with each row including a plurality of light-emitting units, a plurality of light-emitting units in the first row of pixels share the reset signal Rst1 and the data writing control signal Gate1, a plurality of light-emitting units in the n-th row of pixels share the reset signal Rstn and the data writing control signal Gaten, and all the light-emitting units in the n rows of pixels share the operation control signal EM and the reference voltage signal Vramp_T, where n is greater than 1. Further, the reset signal Rst2 input to the second row of pixels and the data writing control signal Gate 1 input to the first row of pixels may be shared, and the reset signal Rstn input to the n-th row of pixels and the data writing control signal Gate (n−1) input to the (n−1)-th row of pixels may be shared.

Figure 9:
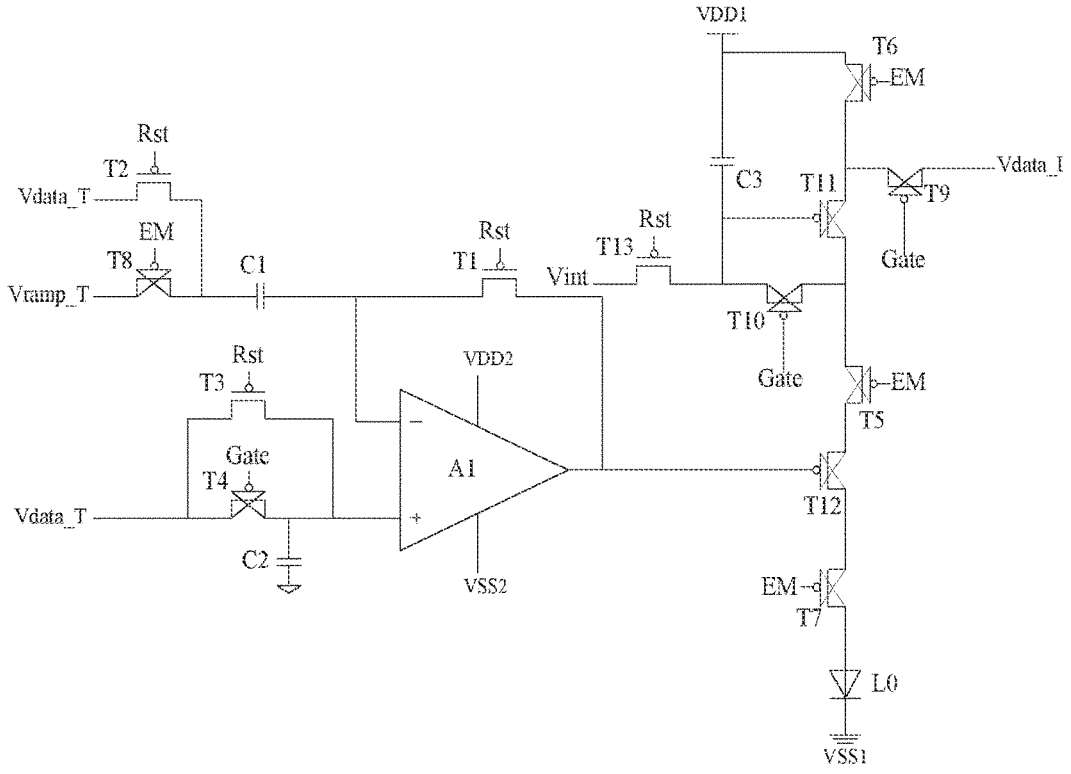
FIGS. 9-11 illustrate an equivalent circuit diagram of a pixel driving circuit at different stages according to an example of the present disclosure.

As shown in FIGS. 8 and 9, at a reset stage S1, the reset signal Rst is of low level. The first switching element T1, the second switching element T2, the third switching element T3 and the reset transistor T13 are all turned on and the remaining transistors are turned off. The output terminal and the inverting input terminal of the comparator A1 are in communication, and the time signal Vdata_T is written into the second terminal of the first energy storage element C1 and the non-inverting input terminal of the comparator A1 respectively, so that the potential of the first terminal of the first energy storage element C1 is equal to the potential of the inverting input terminal of the comparator A1, and the potential of the second terminal of the first energy storage element C1 is equal to the potential of the non-inverting input terminal of the comparator A1. Thus, the potential difference between the second terminal and the first terminal of the first energy storage element C1 is the offset voltage of the comparator A1. At the same time, the reset transistor T13 initializes the current storage capacitor C3, so that potentials at both terminals of the current storage capacitor C3 are the first power signal VDD1 and the reference signal Vint, respectively. It is to be noted that the reference signal Vint may be a voltage of low potential, for example, grounded.

Figure 10:
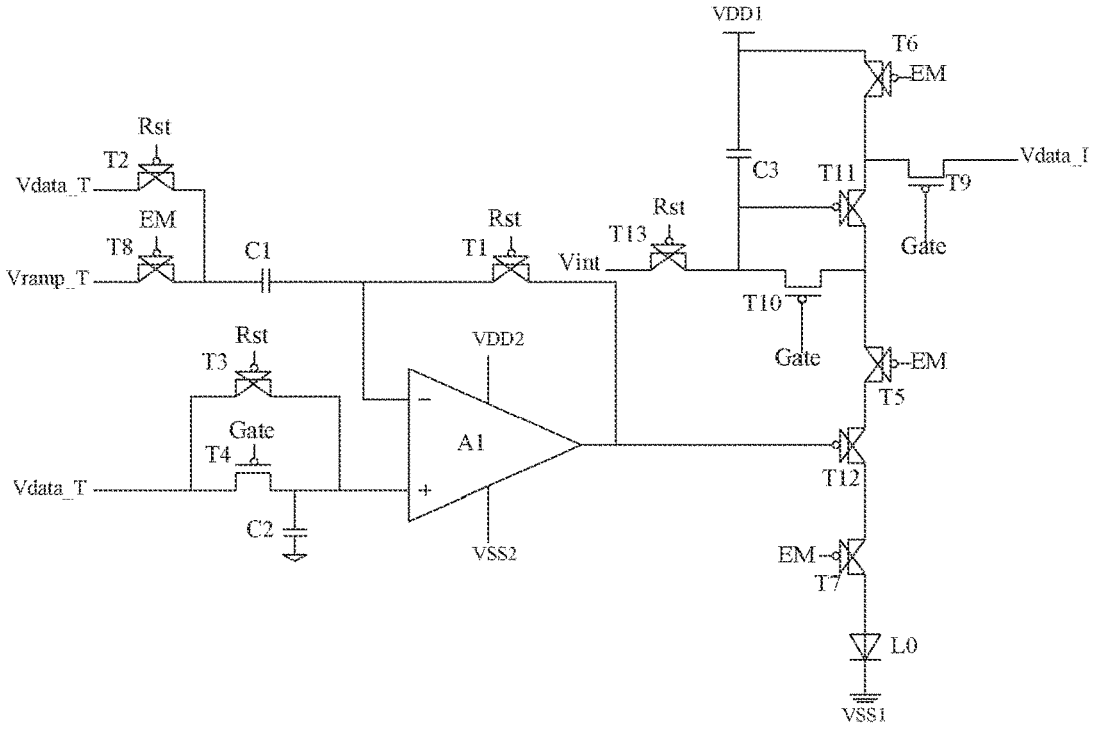

As shown in FIGS. 8 and 10, at a data writing stage S2, the data writing control signal Gate is of low level. The current writing transistor T9, the compensation transistor T10 and the fourth switching element T4 are all turned on and the remaining transistors are turned off. The time signal Vdata_T is written into the second energy storage element C2 through the fourth switching element T4 for storage and holding. By presetting a value of the potential of the reference signal Vint, a difference of the potential of the control terminal of the drive transistor T11 and the potential of the first terminal of the drive transistor T1 is made smaller than a threshold voltage Vth, so that the drive transistor T11 is also in an ON state. The current signal Vdata_I is written into the control terminal of the drive transistor T11 through the current writing transistor T9. When the potential of the control terminal of the drive transistor T11 changes to (Vdata_I+Vth), the drive transistor T11 is turned off. The potential (Vdata_I+Vth) of the control terminal of the drive transistor T11 is stored and held by the current storage capacitor C3, where Vth is a negative value.

Figure 11:
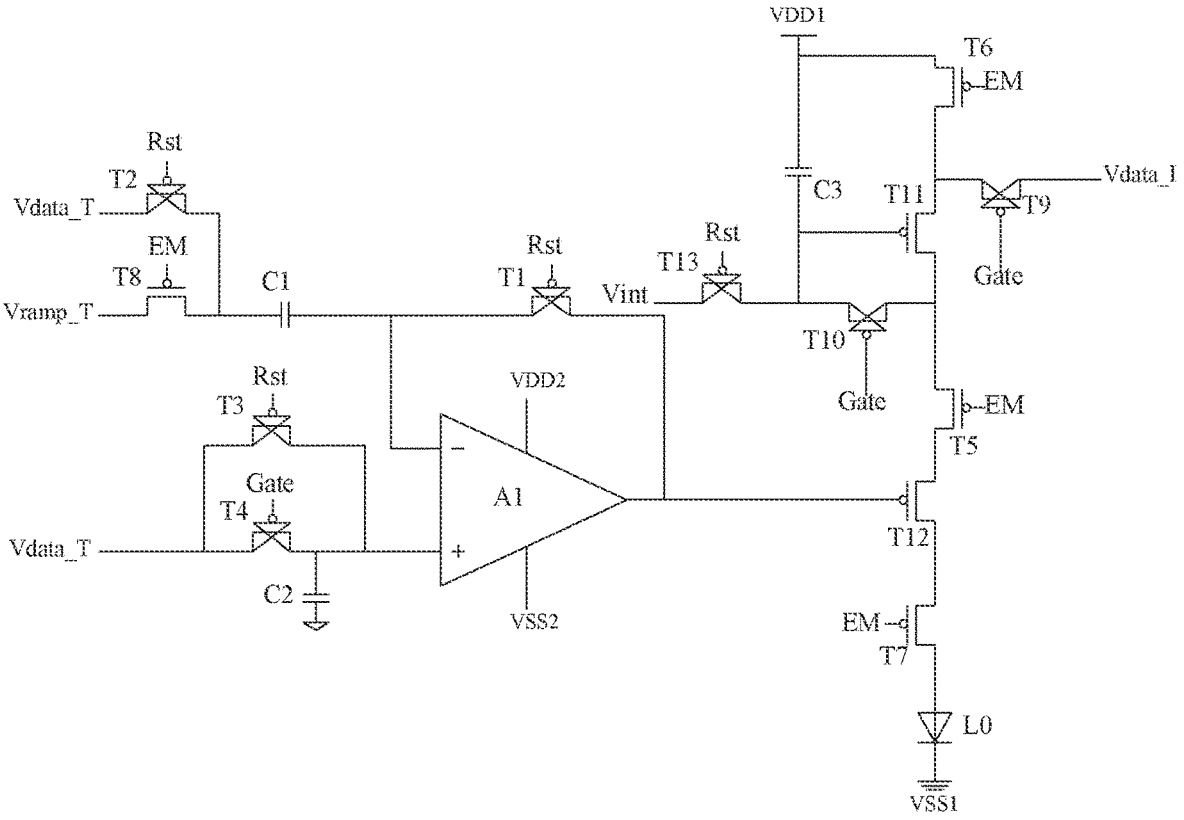

As shown in FIGS. 8 and 11, at a light-emitting stage S3, the operation control signal EM is of low level. The drive transistor T11, the voltage writing transistor T8, the fifth transistor T5, the sixth transistor T6 and the seventh transistor T7 are all turned on. An operation current generated by the drive transistor T11 and to be applied to the light-emitting unit L0 is as follows:

$$I_{DS} = \frac{1}{2}\mu C_{ox}\frac{W}{L}(V_{GS} - Vth)^2 = \frac{1}{2}\mu C_{ox}\frac{W}{L}(Vdata_I + Vth - VDD1 - Vth)^2 = \frac{1}{2}\mu C_{ox}\frac{W^2}{L}(\text{Vdata_I} - VDD1)^2$$

where μ is an electron mobility, Cox is capacitance of a gate oxide layer, $V_{GS}$ is a voltage of the control terminal of the drive transistor T11 relative to the first terminal, $$\frac{W}{L}$$

is a width-to-length ratio of a channel region of the drive transistor T11. It can be known that the magnitude of the operation current is independent from the threshold voltage Vth of the drive transistor T11, thereby eliminating the influence of the threshold voltage on the operation current. The current generated by the drive transistor T11 is to enable the light-emitting unit L0 to operate in a high current density range, avoiding the problems of drift of a principal wave peak along with change of the current density and poor brightness uniformity under a low current density. It can be known from experiments that when the width-to-length ratio of a channel region of the drive transistor T11 is greater than 3, the above problems can be avoided and the brightness uniformity of the light-emitting unit L0 is made to be in a superior range. In this example, the width-to-length ratio of the channel region of the drive transistor T11 is 4. In other examples, the width-to-length ratio of the channel region of the drive transistor T11 may be any one of 5, 6, 7, 8, 9 and 10 and the like, which is greater than 3. In the time length controlling module 1, the inverting input terminal of the comparator A1 inputs the reference voltage signal Vramp_T, and the non-inverting input terminal of the comparator A1 inputs the time signal Vdata_T stored in the second energy storage element C2. When the reference voltage signal Vramp_T is smaller than the time signal Vdata_T, the output terminal of the comparator A1 outputs a high level VDD2. At this time, the output transistor T12 is turned off and the light-emitting unit L0 does not emit light. When the reference voltage signal Vramp_T is greater than the time signal Vdata_T, the output terminal of the comparator A1 outputs a low level VSS2. At this time, the output transistor T12 is turned on and the light-emitting unit L0 emits light.

An example of the present disclosure further provides a method of driving a pixel driving circuit, which is applied to drive the pixel driving circuit mentioned in the above examples. The method of driving the pixel driving circuit may include: writing an offset voltage of the comparator A1 into the first energy storage element C1 by using the offset voltage writing sub-circuit 102; enabling the current controlling module 2 to output a current signal, and enabling one of the first output sub-circuit 100 and the second output sub-circuit 101 to output a time signal Vdata_T, and the other to output a reference voltage signal Vramp_T so that the comparator A1 outputs a comparison signal according to the time signal Vdata_T and the reference voltage signal Vramp_T; causing the outputting module 3 to turn on in response to the comparison signal and controlling a current of the light-emitting unit L0 according to the current signal by the outputting module 3. Because the pixel driving circuit driven by the driving method according to the examples of the present disclosure is same as the pixel driving circuit mentioned in the above examples, the same beneficial effects will be brought and will not be repeated herein.

An example of the present disclosure further provides a display device. The display device may include a plurality of pixel driving circuits described in any example above and a plurality of light-emitting units connected with the pixel driving circuits one to one. The display device may be a product or component having display functions, such as a mobile phone, a tablet computer, a TV, a laptop computer, a digital photo frame or a navigator. Because the pixel driving circuits in the display device in the examples of the present disclosure are same as the pixel driving circuit mentioned in the above examples, the same beneficial effects will be brought and will not be repeated herein.

The above descriptions are merely preferred examples of the present disclosure and are not intended to limit the present disclosure in any form. Although the present disclosure is described with the preferred examples, these preferred examples are not used to limit the present disclosure. Some changes or modifications made by those skilled in the art using the technical contents disclosed above without departing from the scope of the technical solution of the present disclosure shall be deemed as equivalent embodiments of the equivalent changes. Any simple corrections, equivalent changes or modifications made to the above examples by those skilled in the art based on the technical essence of the present disclosure without departing the scope of the technical solutions of the present disclosure shall all fall within the scope of protection of the present disclosure.

What is claimed is:

1. A pixel driving circuit, comprising:

a time length controlling module, comprising a first output sub-circuit, a second output sub-circuit, a comparator, a first energy storage element, and an offset voltage writing sub-circuit, wherein a first terminal of the first energy storage element is connected with a first input terminal of the comparator, the first output sub-circuit is connected with a second terminal of the first energy storage element, the second output sub-circuit is connected with a second input terminal of the comparator;

the offset voltage writing sub-circuit is configured to write an offset voltage of the comparator into the first energy storage element;

one of the first output sub-circuit and the second output sub-circuit is configured to output a time signal and the other of the first output sub-circuit and the second output sub-circuit is configured to output a reference voltage signal; and the comparator is configured to output a comparison signal according to the time signal and the reference voltage signal;

a current controlling module, configured to output a current signal; and an outputting module, configured to turn on in response to the comparison signal and control a current of a light-emitting unit according to the current signal.

2. The pixel driving circuit according to claim 1, wherein one of the first input terminal and the second input terminal of the comparator is an inverting input terminal and the other is a non-inverting input terminal, and the offset voltage writing sub-circuit comprises:

a first switching element, configured to turn on in response to an energy storage signal so as to communicate an output terminal of the comparator with the inverting input terminal of the comparator; and a switching unit, configured to turn on in response to the energy storage signal so as to communicate the second terminal of the first energy storage element with the non-inverting input terminal of the comparator.

3. The pixel driving circuit according to claim 2, further comprising:

a resetting module, configured to turn on in response to a reset signal so as to reset the current controlling module, wherein the energy storage signal and the reset signal are shared.

4. The pixel driving circuit according to claim 2, wherein the switching unit comprises:

a second switching element, configured to turn on in response to the energy storage signal so as to write a preset signal into the second terminal of the first energy storage element; and a third switching element, configured to turn on in response to the energy storage signal so as to write the preset signal into the non-inverting input terminal of the comparator.

5. The pixel driving circuit according to claim 4, wherein the one of the first output sub-circuit and the second output sub-circuit that is configured to output the time signal is a time signal writing sub-circuit, and the time signal writing sub-circuit comprises:

a second energy storage element, wherein a first terminal of the second energy storage element is grounded and a second terminal of the second energy storage element is an output terminal of the time signal writing sub-circuit; and a fourth switching element, configured to turn on in response to a data writing control signal so as to write the time signal into the second terminal of the second energy storage element.

6. The pixel driving circuit according to claim 5, wherein the preset signal and the time signal are shared.

7. The pixel driving circuit according to claim 5, wherein the first switching element, the second switching element and the third switching element correspond to a first transistor, a second transistor and a third transistor, respectively;

a control terminal of the first transistor receives the energy storage signal, a first terminal of the first transistor is connected with the output terminal of the comparator and a second terminal of the first transistor is connected with the inverting input terminal of the comparator;

a control terminal of the second transistor receives the energy storage signal, a first terminal of the second transistor receives the preset signal, and a second terminal of the second transistor is connected with the second terminal of the first energy storage element; and a control terminal of the third transistor receives the energy storage signal, a first terminal of the third transistor receives the preset signal, and a second terminal of the third transistor is connected with the non-inverting input terminal of the comparator.

8. The pixel driving circuit according to claim 5, wherein the current controlling module comprises a current writing sub-circuit and a compensation sub-circuit, the compensation sub-circuit is connected with the current writing sub-circuit and the outputting module, and the compensation sub-circuit comprises a compensation transistor, a current storage capacitor and a drive transistor;

wherein a first terminal of the drive transistor is connected with the current writing sub-circuit, a second terminal of the drive transistor is connected with a first terminal of the compensation transistor, a control terminal of the drive transistor and a second terminal of the compensation transistor are both connected with a first terminal of the current storage capacitor, a control terminal of the compensation transistor is configured to receive the data writing control signal, and a second terminal of the current storage capacitor receives a first power signal.

9. The pixel driving circuit according to claim 8, wherein a width-to-length ratio of a channel region of the drive transistor is greater than 3.

10. The pixel driving circuit according to claim 1, further comprising:

an operation controlling module, configured to turn on in response to an operation control signal so as to transmit the current signal to the outputting module.

11. The pixel driving circuit according to claim 1, wherein the reference voltage signal is a ramp signal, a triangular wave signal, a sawtooth wave signal, a sine wave signal or a cosine wave signal.

12. The pixel driving circuit according to claim 8, further comprising:

a resetting module, configured to turn on in response to a reset signal so as to reset the current controlling module; and an operation controlling module, configured to turn on in response to an operation control signal so as to transmit the current signal to the outputting module.

13. A method of driving a pixel driving circuit, applied to drive the pixel driving circuit according to claim 1, and the method of driving the pixel driving circuit comprising:

writing the offset voltage of the comparator into the first energy storage element by using the offset voltage writing sub-circuit;

enabling the current controlling module to output a current signal, and enabling one of the first output sub-circuit and the second output sub-circuit to output a time signal, and the other to output a reference voltage signal so that the comparator outputs a comparison signal according to the time signal and the reference voltage signal;

causing the outputting module to turn on in response to the comparison signal, and controlling a current of a light-emitting unit according to the current signal by the outputting module.

14. A display device, comprising a plurality of pixel driving circuits, and a plurality of light-emitting units connected with the plurality of pixel driving circuits one to one, wherein each of the pixel driving circuits comprises:

a time length controlling module, comprising a first output sub-circuit, a second output sub-circuit, a comparator, a first energy storage element, and an offset voltage writing sub-circuit, wherein a first terminal of the first energy storage element is connected with a first input terminal of the comparator, the first output sub-circuit is connected with a second terminal of the first energy storage element, the second output sub-circuit is connected with a second input terminal of the comparator;

the offset voltage writing sub-circuit is configured to write an offset voltage of the comparator into the first energy storage element;

one of the first output sub-circuit and the second output sub-circuit is configured to output a time signal and the other is configured to output a reference voltage signal; and the comparator is configured to output a comparison signal according to the time signal and the reference voltage signal;

a current controlling module, configured to output a current signal; and an outputting module, configured to turn on in response to the comparison signal and control a current of a corresponding light-emitting unit according to the current signal.

15. The display device according to claim 14, wherein one of the first input terminal and the second input terminal of the comparator is an inverting input terminal and the other is a non-inverting input terminal, and the offset voltage writing sub-circuit comprises:

a first switching element, configured to turn on in response to an energy storage signal so as to communicate an output terminal of the comparator with the inverting input terminal of the comparator; and a switching unit, configured to turn on in response to the energy storage signal so as to communicate the second terminal of the first energy storage element with the non-inverting input terminal of the comparator.

16. The display device according to claim 15, wherein the switching unit comprises:

a second switching element, configured to turn on in response to the energy storage signal so as to write a preset signal into the second terminal of the first energy storage element; and a third switching element, configured to turn on in response to the energy storage signal so as to write the preset signal into the non-inverting input terminal of the comparator.

17. The display device according to claim 16, wherein the one of the first output sub-circuit and the second output sub-circuit that is configured to output the time signal is a time signal writing sub-circuit, and the time signal writing sub-circuit comprises:

a second energy storage element, wherein a first terminal of the second energy storage element is grounded and a second terminal of the second energy storage element is an output terminal of the time signal writing sub-circuit; and a fourth switching element, configured to turn on in response to a data writing control signal so as to write the time signal into the second terminal of the second energy storage element.

18. The display device according to claim 17, wherein the preset signal and the time signal are shared.

19. The display device according to claim 17, wherein the first switching element, the second switching element and the third switching element correspond to a first transistor, a second transistor and a third transistor, respectively;

a control terminal of the first transistor receives the energy storage signal, a first terminal of the first transistor is connected with the output terminal of the comparator and a second terminal of the first transistor is connected with the inverting input terminal of the comparator;

a control terminal of the second transistor receives the energy storage signal, a first terminal of the second transistor receives the preset signal, and a second terminal of the second transistor is connected with the second terminal of the first energy storage element; and a control terminal of the third transistor receives the energy storage signal, a first terminal of the third transistor receives the preset signal, and a second terminal of the third transistor is connected with the non-inverting input terminal of the comparator.

20. The display device according to claim 17, wherein the current controlling module comprises a current writing sub-circuit and a compensation sub-circuit, the compensation sub-circuit is connected with the current writing sub-circuit and the outputting module, and the compensation sub-circuit comprises a compensation transistor, a current storage capacitor and a drive transistor:

wherein a first terminal of the drive transistor is connected with the current writing sub-circuit, a second terminal of the drive transistor is connected with a first terminal of the compensation transistor, a control terminal of the drive transistor and a second terminal of the compensation transistor are both connected with a first terminal of the current storage capacitor, a control terminal of the compensation transistor is configured to receive the data writing control signal, and a second terminal of the current storage capacitor receives a first power signal.

* * * * *